US007404430B2

(12) United States Patent
Kollman et al.

(10) Patent No.: US 7,404,430 B2
(45) Date of Patent: Jul. 29, 2008

(54) COLLAR FOR VENETIAN BLINDS

(75) Inventors: Michael Kollman, Madison, WI (US); Adam Ward, Madison, WI (US)

(73) Assignee: Lumino, Inc., Madison, WI (US)

( * ) Notice: Subject to any disclaimer, the term of this patent is extended or adjusted under 35 U.S.C. 154(b) by 389 days.

(21) Appl. No.: 11/167,615

(22) Filed: Jun. 27, 2005

(65) Prior Publication Data

US 2006/0289125 A1 Dec. 28, 2006

(51) Int. Cl.
*E06B 9/266* (2006.01)

(52) U.S. Cl. ..... 160/178.1 R

(58) Field of Classification Search ..... 160/178.1 R, 160/168.1 R; 29/24.5; 83/454; 206/320; 294/25, 170; 248/90; 211/184
See application file for complete search history.

(56) References Cited

U.S. PATENT DOCUMENTS 2,787,379 A * 4/1957 Fritz et al. ..... 211/38
4,305,629 A * 12/1981 Friis ..... 312/204
5,799,557 A 9/1998 Wang
5,806,394 A 9/1998 Marocco
5,816,126 A * 10/1998 Pluber ..... 83/167
5,927,172 A 7/1999 Wang
6,196,099 B1 3/2001 Marocco
6,367,637 B1 * 4/2002 Davis et al. ..... 211/85.13
6,761,099 B2 7/2004 Lin et al.
6,793,073 B2 9/2004 Tu
7,044,043 B2 * 5/2006 Cheng ..... 83/522.19
2007/0089583 A1 * 4/2007 Cheng ..... 83/455

* cited by examiner

*Primary Examiner*—Blair M. Johnson
(74) *Attorney, Agent, or Firm*—Buchanan Ingersoll & Rooney PC

(57) ABSTRACT

A collar for a venetian blind has two generally rectangular rings or half rings, one fitting over the headrail and the other fitting over the bottom rail. A sidewall or pair of spaced apart sidewalls extend between the two rings or half rings, such that the headrail and bottom rail are maintained in a desired spaced apart relationship. That spacing corresponds to a distance between the headrail die cavity and a bottom rail die cavity in a cut-down machine. Consequently, the end of a venetian blind to which the collar is attached may be readily inserted into the cutting die of a cut-down machine.

19 Claims, 2 Drawing Sheets

COLLAR FOR VENETIAN BLINDS

FIELD OF INVENTION

The invention relates to devices that are used to hold stock sizes of venetian type blinds for trimming by a cut-down machine so that the blind will fit an opening whose dimensions are provided by a customer.

BACKGROUND OF THE INVENTION

Many home centers and other retailers of window covering products purchase venetian blinds in stock sizes from a blind manufacturer and display those blinds in retail store locations. These retailers have machines, called cut-down machines, which a salesperson or technician can use to trim a stock blind to fit a window, door or other opening having dimensions smaller than the dimensions of a stock blind. Typically, the customer provides these dimensions. For example, a customer may tell a salesperson that the dimensions of the window to be covered by the blind are 34 inches wide and 48 inches tall. The stock blind closest to those dimensions is 36 inches wide and 48 inches in length. Consequently, it will be necessary to cut two inches from the width of the stock blind to create a blind that will fit the customer's window. Because the customer usually wants each of the two ladders in a venetian blind of this size to be the same distance from the edge of the blind nearest the ladder, the retailer will cut away an equal amount of material from each edge of the blind rather than cut all the material from one edge of the blind. In the example, one inch would be cut from each edge of the blind. If the blind is too long for the opening, extra slats or other window covering material can be removed from the bottom of the blind. A cut-down machine is not used for this purpose.

There are several types of blind trimming machines known in the art. One type of blind trimming or cut-down machine has a set of cutting dies that act as the cutting mechanism for trimming a venetian type blind. The operator of these machines must insert the headrail into one die cavity, insert the bottom rail into another die cavity and insert the slats into a third die cavity. Examples of this type of machine can be found in U.S. Pat. Nos. 5,799,557 and 5,927,172 to Wang, U.S. Pat. Nos. 5,806,394 and 6,196,099 to Marocco and U.S. Pat. No. 6,761,099 to Lin et al. In each of these machines the die cavities are in fixed locations relative to one another. Typically, an operator of the machine will remove the blind to be cut from its container and place the blind on a table adjacent the cutting dies. Then the operator will maneuver the headrail, slats and bottom rail until they are positioned within the appropriate die cavities. The machine may have an alignment guide to assist the operator in positioning the blind. In U.S. Pat. No. 5,927,172 Wang discloses an end stop having three recesses, which is positioned opposite the cutting die. The operator positions the headrail, slats and bottom rail within the appropriate recesses prior to cutting.

An operator can spend several minutes removing a venetian blind from its box and positioning the blind on the cut-down machine so that the headrail, slats and bottom rail are aligned with the appropriate die cavities. Consequently, the art has proposed boxes with removable end caps that can be used for venetian blinds such that the blind can be trimmed without fully removing the blind from the box. One example of such a container is disclosed in U.S. Pat. No. 6,793,073 to Tu. Since the headrail and bottom rail of the venetian blind are free to move relative to one another when partially within a container such as that described by Tu, an operator of a cut-down machine must still adjust the relative positions of the headrail, slats and bottom rail to align them with there respective die cavities in the cut-down machine. Consequently, there is a need for a collar that can be placed around a venetian blind to maintain the headrail, slats and bottom rail in relative positions that correspond to the die cavities in the cut-down machine. Such a collar may also restrain the blind from lateral movement within the box during shipping and handling. If such a collar were provided, then an operator of a cut-down machine could rapidly remove one end of a venetian blind from its container and easily insert the headrail, slats and bottom rail into their respective die cavities without handling each one individually.

SUMMARY OF THE INVENTION

We provide a collar for venetian blinds having a generally rectangular first ring or half ring that fits over the headrail of a venetian blind and a generally rectangular second or half ring that fits over the bottom rail of the blind. A pair of spaced apart side walls extend between the two rings and create a cavity sized to receive the slats of a venetian blind. If half rings are used only a single side wall is provided. The sidewall or sidewalls keep the first ring and second ring in a selected spaced apart relationship that corresponds to the spacing between the headrail die cavity and bottom rail die cavity in a cut down machine. Consequently, a venetian blind having an attached collar can be readily inserted into the cutting die of a cut-down machine.

Because the headrail of a venetian blind is wider than the slats of the blind, the opening defined by the sidewalls will be narrower than the opening defined by the first ring. We prefer to provide a series of flanges on the outer surface of each sidewall. The flanges are sized so that a plane tangent to the distal ends of the flanges on one sidewall will be tangent to the side of the first ring. Consequently, when a venetian blind bearing a collar at each end is placed in a box having a width slightly larger than the width of the first ring, the flanges will prevent side to side movement of the blind within the box. We also prefer to provide a similar flange on either side of the second ring which holds the bottom rail.

We further prefer to provide a spacer within the cavity that holds the slats. The spacer may be removable.

Other objects and advantages of our collar for a venetian blind will become apparent from certain present preferred embodiments thereof shown in the drawings.

DESCRIPTION OF THE PREFERRED EMBODIMENTS

Figure 1:
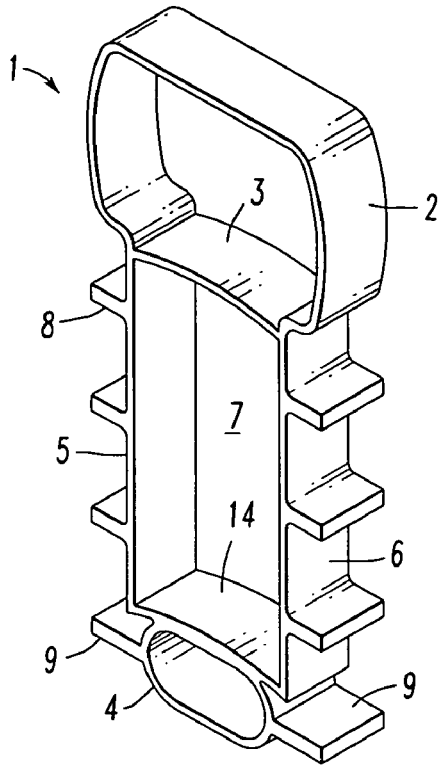
FIG. 1 is a perspective view of a first present preferred embodiment of our collar for a venetian blind.
Figure 2:
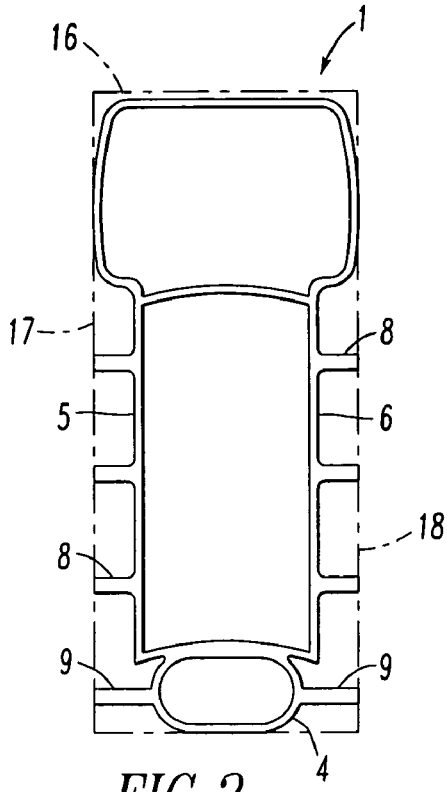
FIG. 2 is an end view of the embodiment shown in FIG. 1 with a box shown in dotted line.
Figure 3:
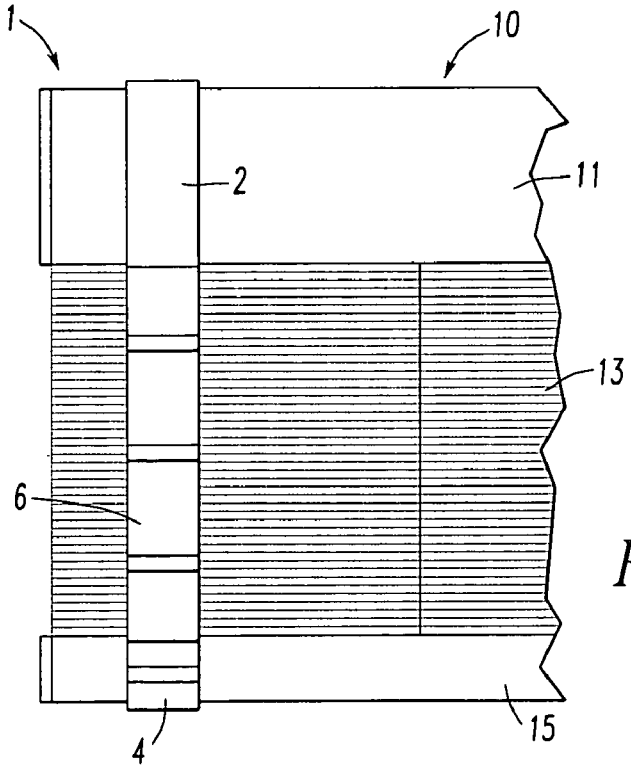
FIG. 3 is a front view of one end of a venetian blind having the collar shown in FIGS. 1 and 2 attached to one end.

A first present preferred embodiment of our collar 1 for venetian blinds, shown in FIGS. 1, 2 and 3 has a generally rectangular first ring 2 and a generally rectangular second ring 4 separated by a pair of spaced apart sidewalls 5, 6. The first ring 2 is sized to fit over a headrail 12 of a venetian blind 10 as shown in FIG. 3. The second ring 2 is sized to fit over the bottom rail 15. The sidewalls 5 and 6 define a cavity 7 into which the slats 13 fit and maintain the first ring and second ring a selected distance apart. That distance corresponds to a spacing between the headrail die cavity and bottom rail die cavity in a cut-down machine. Consequently, the end of a venetian blind having the collar 1 attached to that end as shown in FIG. 3 can be readily inserted into the die of the cut-down machine. Moreover, such insertion can be made without fully removing the blind from the box in which it was shipped.

We further prefer to provide a series of flanges 8 extending from the sidewalls and a pair of flanges 9 extending from the second ring. The flanges are sized such that when a venetian blind is placed in a box 16 of a selected size, the distal ends of the flanges and the sides of the first ring will abut the sides 17, 18 of the box 16 as shown in FIG. 2. Stated another way, a plane passing over the distal ends of one set of flanges, such as side 17, and a plane passing over the distal ends of a second set of flanges, such as side 18, will be generally parallel and a selected distance apart. Furthermore, that distance will correspond to the width at the first ring 2.

The slats in aluminum and vinyl venetian blinds are curved across their width. Consequently, we prefer that the bottom 3 of the first ring 2 and the top of 14 of the second ring 4 be similarly curved.

Figure 4:
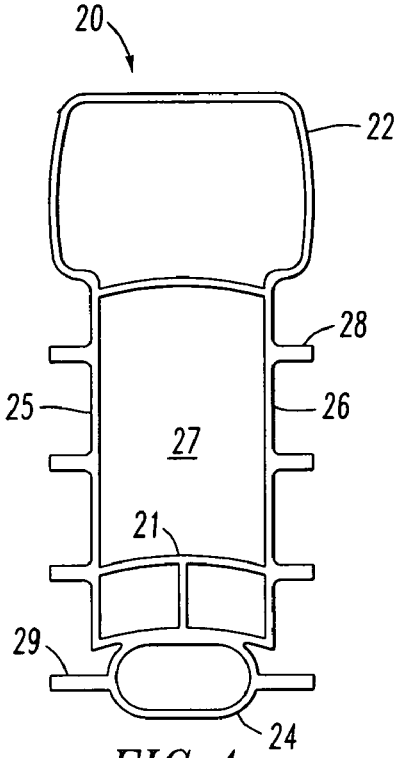
FIG. 4 is an end view of a second present preferred embodiment of our collar for a venetian blind.

Stock blinds are often sold in two or more standard lengths. These blinds have the same headrail and bottom rail, but the number of slats is different. Nevertheless the same die is used to trim all standard lengths. Hence, the spacing between the headrail and the bottom rail is the same for all blind lengths when the blind is placed into the die cavities of the cut-down machine. A second present preferred collar 20 shown in FIG. 4 is similar to the first embodiment and is intended for use with shorter blinds. This collar 20 has a first ring 22 for the headrail, a second ring 24 for the bottom rail and two spaced apart sidewalls 25 and 26 that define the cavity 27 for the slats. Flanges 28 and 29 extend from the sidewalls 25, 26 and the second ring 24. In this embodiment we provide a spacer 21 such that the cavity 27 is smaller than the cavity 7 in the first embodiment. The spacer 21 may be fixed to the sidewalls as shown in FIG. 4 or may be removable.

Figure 5:
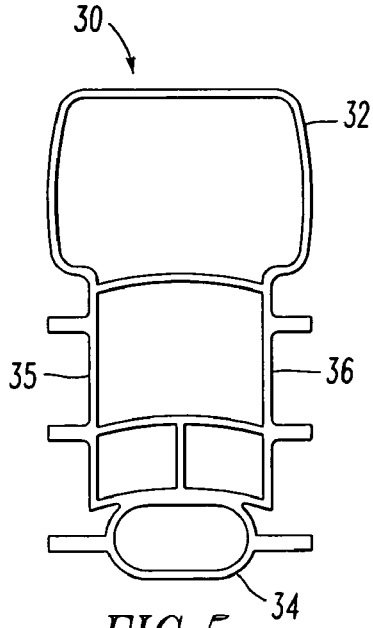
FIG. 5 is an end view of a third present preferred embodiment of our collar for a venetian blind.

A third present preferred collar 30 shown in FIG. 5 is similar to the first embodiment, but has shorter sidewalls 35, 36 between the first ring 32 and the second ring 34. When this collar is used the headrail and bottom rail of a venetian blind bearing the collar will be closer together than a blind having the collar shown in FIG. 1. This collar would be used when the bottom rail die cavity and the headrail die cavity are closer together in the cut-down machine die than in the die used with the first embodiment. Typically, this embodiment would be used for a blind having aluminum slats while the embodiments of FIGS. 1 through 4 would be used for a blind having vinyl slats.

Figure 6:
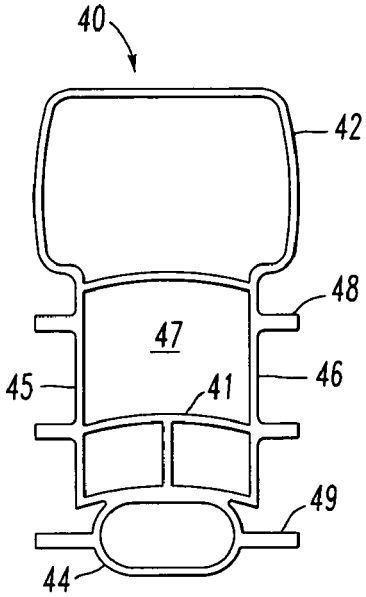
FIG. 6 is an end view of a fourth present preferred embodiment of our collar for a venetian blind.

We may provide an embodiment similar to that shown in FIG. 5 but having a spacer. This collar 40 shown in FIG. 6 has a generally rectangular first ring 42 and generally rectangular second ring 44 separated by sidewalls 45 and 46. Flanges 48, 49 extend from the sidewalls or second ring. Spacer 41 is provided within the slat cavity 47. That spacer may be fixed or removable.

Figure 7:
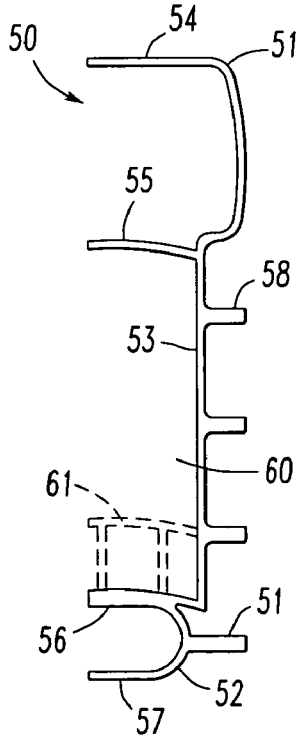
FIG. 7 is an end view of a fifth present preferred embodiment of our collar for a venetian blind.

Other embodiments can be made by cutting any of the embodiments shown in FIGS. 1 through 6 through a plane that is parallel to dotted lines 17 and 18 in FIG. 2. These embodiments would be similar to the embodiment shown in FIG. 7. That embodiment 50 has a first half ring 51 having a bottom 55 that is sized to fit over the headrail of a venetian blind and a second half ring 52 having a top 56 that is sized to fit over the bottom rail of a venetian blind. The half rings 51 and 52 are connected to opposite ends of a sidewall 53. The sidewall is sized to keep the half rings and the headrail and bottom rail a selected distance apart. That selected distance corresponds to the distance between the cavities in the cutting side of a cutting machine that receives the headrail and bottom rail. As in the previous embodiments, flanges 58 and 59 may extend from the sidewall 53 and second half ring 52. The portions 54, 55 of the split rings that extend above or below the headrail should have a length that is greater than half the width of the headrail so that the collar is not easily dislodged from the headrail. However, any length could be used. Similarly, the portions 56, 57 of the second half ring that extend above and below the bottom rail should have a length that is greater than half the width of the bottom rail. But, again smaller lengths could be used. Sidewall 53, the bottom 55 of the first half ring 51 and the top 56 of the second half ring 52 define a cavity 60 that will receive the slats of a first venetian blind. If desired, a spacer 61 shown in dotted line may be provided. This spacer may or may not be removable. When this collar 50 is placed on a venetian blind a front view of the blind and collar would look like FIG. 3.

We prefer to mold our collar from plastic material, such as polyvinyl chloride. However, cardboard or other materials could be used. Indeed, the entire structure could be made from wire.

Although we have shown and described certain present preferred embodiments of our collar for venetian blinds, it is to be distinctly understood that our invention is not so limited but may be variously embodied within the scope of the following claims.

We claim:

1. A venetian blind with at least one collar comprising:

a venetian blind having a headrail, a bottom rail and a set of slats hung on ladders extending from the headrail to the bottom rail; and a first collar, the first collar comprised of:

a first half ring sized to receive the headrail of the venetian blind, the first half ring having a bottom;

a second half ring sized to receive the bottom rail of the venetian blind, the second half ring having a top;

a side wall extending from the bottom of the first half ring to the top of the second half ring, the side wall, bottom of the first half ring and top of the second half ring defining a cavity sized to receive the plurality of slats of the venetian blind; and wherein the first collar is connected to the venetian blind and is sized and configured such that the first collar and venetian blind can be enclosed within a package sized and configured to hold the venetian blind.

2. The venetian blind with at least one collar of claim 1 wherein the first half ring has a first selected width and the second half ring has a second selected width, the second selected width being less than the first selected width.

3. The venetian blind with at least one collar of claim 1 also comprising at least one flange having a proximate end attached the side wall and a distal end extending away from the cavity.

4. The venetian blind with at least one collar of claim 1 also comprising at least one spacer within the cavity.

5. The venetian blind with at least one collar of claim 4 wherein the at least one spacer is removable.

6. The venetian blind with at least one collar of claim 1 also comprising at least one flange attached to the side wall.

7. The venetian blind with at least one collar of claim 1 also comprising at least one flange attached to the second half ring.

8. The venetian blind with at least one collar of claim 1 also comprising at least one flange attached to the first half ring.

9. The venetian blind with at least one collar of claim 3 wherein the first half ring has a first selected width and a distance measured from the distal end of the at least one flange to the side wall is not greater than the first selected width.

10. The venetian blind with at least one collar of claim 1 wherein the first collar is comprised of a material selected from the group consisting of plastics, cardboard and metal.

11. The venetian blind with at least one collar of claim 9 wherein the second half ring has a second selected width that is less than the first selected width.

12. The venetian blind with at least one collar of claim 1 further comprising:

a second collar, the second collar comprised of:

a first half ring sized to receive the headrail of the venetian blind, the first half ring having a bottom;

a second half ring sized to receive the bottom rail of the venetian blind, the second half ring having a top;

a side wall extending from the bottom of the first half ring to the top of the second half ring, the side wall, bottom of the first half ring and top of the second half ring defining a cavity sized to receive the plurality of slats of the a venetian blind; and wherein the second collar is connected to the venetian blind and is sized and configured such that the second collar and venetian blind can be enclosed within a package sized and configured to hold the venetian blind.

13. The venetian blind with at least one collar of claim 12 wherein the first collar is adjacent the second collar.

14. The venetian blind with at least one collar of claim 12 wherein the first collar engages the second collar.

15. The venetian blind with at least one collar of claim 14 wherein the first half ring of the first collar engages the first half ring of the second collar.

16. The venetian blind with at least one collar of claim 13 wherein the first collar is further comprised of at least one first flange having a distal end and a proximate end, the proximate end of the at least one first flange attached to the side wall of the first collar such that the distal end of the at least one first flange extends away from the cavity of the first collar and wherein the second collar is further comprised of at least one second flange having a distal end and a proximate end, the proximate end of the at least one second flange attached to the side wall of the second collar such that the distal end of the at least one second flange extends away from the cavity of the second collar.

17. The venetian blind with at least one collar of claim 16 wherein a first selected width is defined between the first half ring of the first collar and first half ring of the second collar and wherein the at least one first flange and at least one second flange lie in a common plane and a distance from the distal end of the at least one first flange to the distal end of the at least one second flange is not greater than the first selected width.

18. The venetian blind with at least one collar of claim 12 wherein the first collar is attached to the second collar.

19. The venetian blind with at least one collar of claim 18 wherein first collar and second collar are a unitary structure.

* * * * *

UNITED STATES PATENT AND TRADEMARK OFFICE

CERTIFICATE OF CORRECTION

PATENT NO. : 7,404,430 B2
APPLICATION NO. : 11/167615
DATED : July 29, 2008
INVENTOR(S) : Michael Kollman and Adam Ward It is certified that error appears in the above-identified patent and that said Letters Patent is hereby corrected as shown below:

At Column 5, claim 12, line 36, after "the", delete --a--.

Signed and Sealed this

Thirtieth Day of September, 2008

JON W. DUDAS
*Director of the United States Patent and Trademark Office*